United States Patent [19]

Hutchins

[11] 3,973,081

[45] Aug. 3, 1976

[54] FEEDBACK RESIDUE COMPRESSION FOR DIGITAL SPEECH SYSTEMS

[75] Inventor: Sandra E. Hutchins, Redondo Beach, Calif.

[73] Assignee: TRW Inc., Redondo Beach, Calif.

[22] Filed: Sept. 12, 1975

[21] Appl. No.: 612,992

[52] U.S. Cl. ..... 179/1 SA; 333/14; 179/15.55 R

[51] Int. Cl.[2] ..... G10L 1/06

[58] Field of Search ..... 179/1 SA, 1 SC, 1 VL, 179/15.55 R; 333/14; 325/62, 38 R, 38 A, 38 B

[56] References Cited

UNITED STATES PATENTS

| | | | |
|---|---|---|---|
| 3,500,441 | 3/1970 | Brolin | 333/14 |
| 3,609,551 | 9/1971 | Brown | 333/14 |
| 3,631,520 | 12/1971 | Atal | 179/1 SA |
| 3,769,612 | 10/1973 | Yamazaki | 325/62 |

*Primary Examiner*—Kathleen H. Claffy
*Assistant Examiner*—E. Matt Kemeny
*Attorney, Agent, or Firm*—Daniel T. Anderson; Edwin A. Oser; Jerry A. Dinardo

[57] ABSTRACT

A digital speech compression system uses a predictive feedback loop. The digital speech signals are compressed within the feedback loop for reducing the transmitter bandwidth. The system comprises a first adder into which the digital signal is fed followed by a quantizer and a compression logic. The predictive loop includes a second adder coupled to the compression logic and followed by a digital predictive filter. The output of the filter is impressed in a negative sense on the first adder and in a positive sense on the second adder. Specifically, the quantizer and compression logic may consist of a two-valued limiter followed by a compressor and a converter in the feedback loop or alternatively the limiter may be followed by a converter while the compressor is disposed outside the feedback loop to provide sample by sample compression.

6 Claims, 6 Drawing Figures

FEEDBACK RESIDUE COMPRESSION FOR DIGITAL SPEECH SYSTEMS

BACKGROUND OF THE INVENTION

This invention relates generally to digital speech communication systems and particularly to such a system having feedback residue compression in its predictive feedback loop.

Bandwidth compression for speech signals has generally been accomplished in two different manners. Thus, the compression may be accomplished by the time domain techniques which operate at relatively high bit rates of between 16–40 kilobits per second. Among these time domain techniques are delta modulators where the difference between the estimate of the predictive feedback and the actual input is small. The other bandwidth compression techniques are spectral domain techniques such as vocoders. These systems operate at very low bit rates between 2.4 and 4.8 kilobits per second.

The spectral domain systems are susceptible to errors induced by background noise. This is a result of their restrictive manner of compressing the signal input. Due to their low bandwidth they do not permit to preserve the fidelity of speech.

It is therefore desirable to provide a speech processing system which compresses both the speech and the noise and possibly giving preference to the speech. For this reason time domain techniques appear to have certain advantages.

Among the systems are continuously variable slope delta modulation techniques. This simply means that the slope or the size of the increment can be changed or varied.

Other time domain systems which are characterized by relatively low data rates are adaptive predictive coding systems. In particular the adaptive predictive coding system is characterized by higher intelligibility of the speech and speech quality than can be achieved at lower data rates than can be utilized with delta modulation. However, one of the problems with the adaptive predictive coding system is the complexity of the required hardware.

It is accordingly an object of the present invention to provide a digital speech compression system of the type having a predictive feedback loop and which is characterized by greater simplicity.

A further object of the present invention is to provide such a speech compression system where the compression is achieved by limiting the number of sequences of quantizer levels that may be fed back to the loop.

Another object of the present invention is to provide a predictive speech compression system where the residue stream is compressed within the quantizer loop.

SUMMARY OF THE INVENTION

A digital speech compression system in accordance with the present invention comprises a digital source of speech. This may, for example, be a speech signal source followed by an analog-to-digital converter. The converter is followed in sequence by a first adder, a quantizer and a compression logic. The quantizer may, for example, consist of a two-valued limiter. The output of the compression logic is the compressed digital speech which then goes to the transmission channel.

A predictor loop is provided between the compression logic and the first adder. This includes a second adder coupled to the compression logic. The output of the second adder is fed to a digital predictive filter. The filter output then is connected in a negative sense to the first adder and in a positive sense to the second adder.

The compression logic may consist of a compressor followed by a converter in the feedback loop. Alternatively, the limiter may be followed by a converter while the actual compressor is disposed outside of the feedback loop.

The novel features that are considered characteristic of this invention are set forth with particularity in the appended claims. The invention itself, however, both as to its organization and method of operation, as well as additional objects and advantages thereof, will best be understood from the following description when read in connection with the accompanying drawings.

DESCRIPTION OF THE PREFERRED EMBODIMENTS

Figure 1:
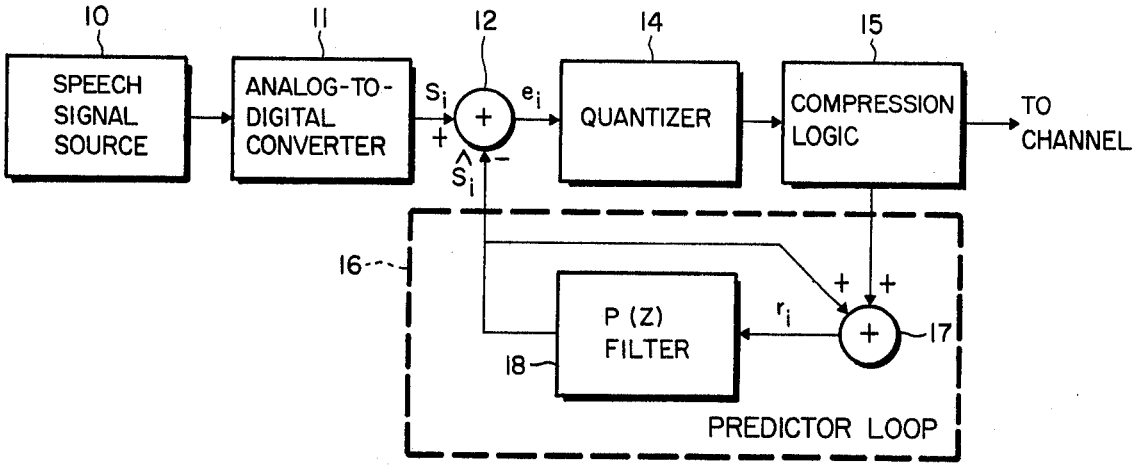
FIG. 1 is a diagram in block form illustrating generally the feedback residue compression for a digital speech system in accordance with the present invention.
Figure 2:
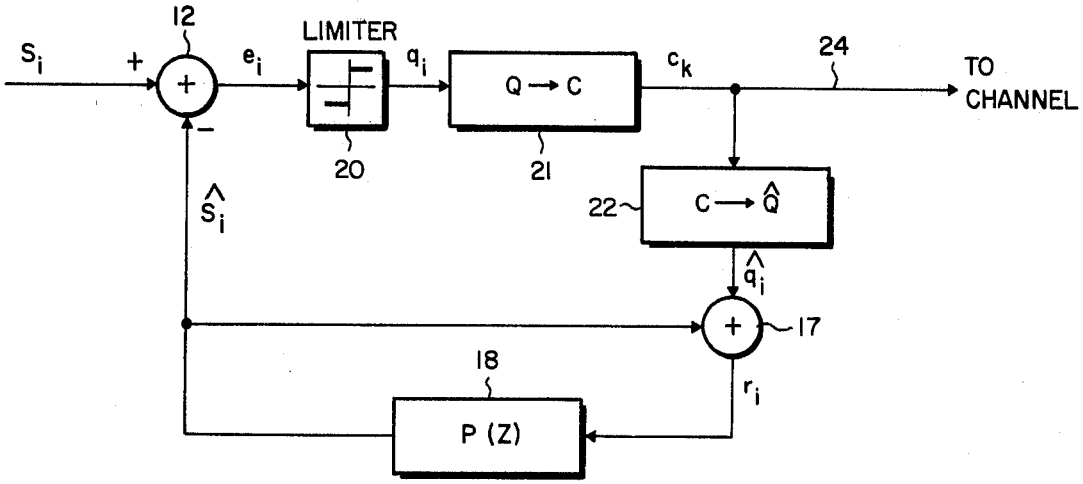
FIG. 2 is a block diagram of a first embodiment of the invention utilizing sample-by-sample compression and which is somewhat limited as to the coding that can be used for the digital compression.
Figure 4:
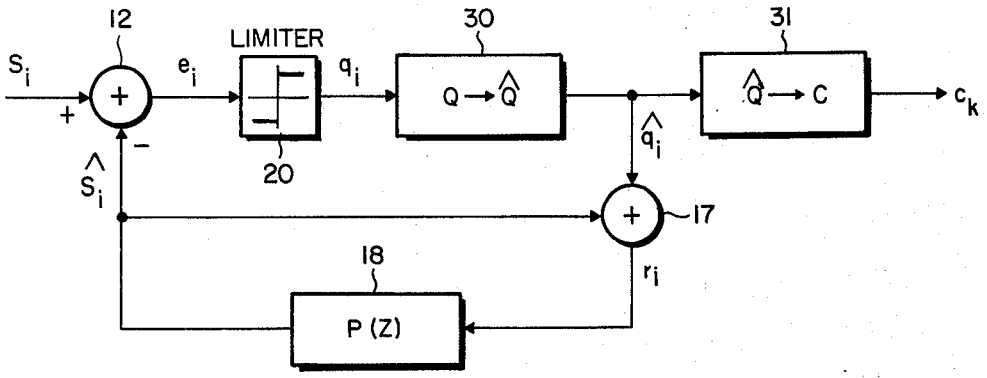
FIG. 4 is a block diagram of a second embodiment of the invention providing sample-by-sample compression and which permits a somewhat wider choice of compression coding.
Figure 5:
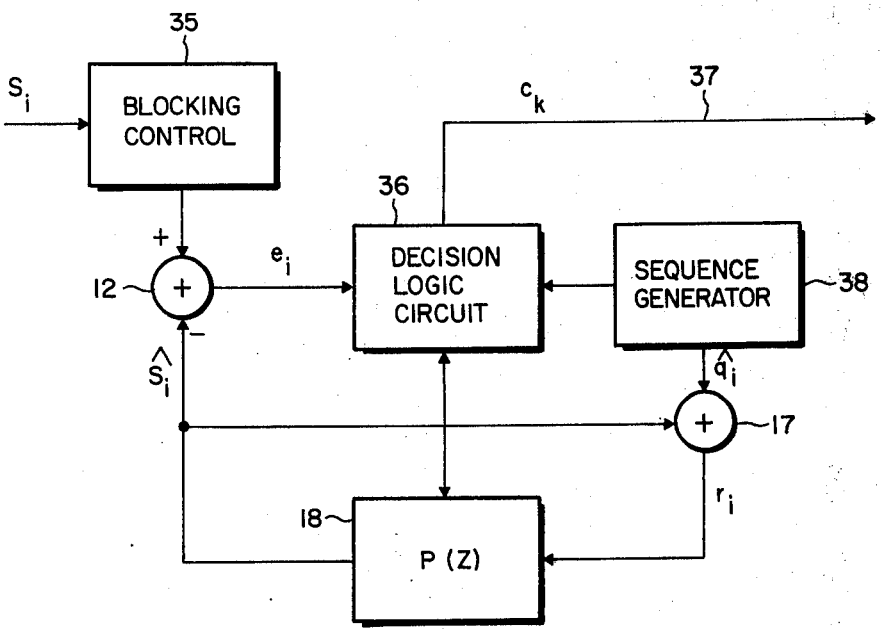
FIG. 5 is a block diagram of a blocked compression system which is carried out block-by-block of the input signals.

Referring now to the drawings and particularly to FIG. 1, there is shown a block diagram of a digital speech compression system in accordance with the present invention. The block diagram of FIG. 1 generally illustrates the invention while FIGS. 2, 4 and 5 show three specific embodiments of the invention.

The block diagram of FIG. 1 includes a speech signal source 10 followed by an analog-to-digital converter 11 to generate digital input signals. These input signals are impressed on an adder 12 which is followed by a quantizer 14 and a compression logic 15. Concerning an explanation of the terms used in the drawings, reference is made to a paper by Rabiner et al. entitled "Terminology in Digital Signal Processing" which appears in IEEE Transactions on Audio and Electroacoustics, Volume AU-20, No. 5, December 1972, pages 322–337.

The adder 12 is a well known digital adder which will add or subtract two digital signals. The quantizer 14 may, for example, include a limiter such as a two-valued limiter for generating quantized digital signals. In other words, the quantizer 14 will output either a $-q$ or $+q$, where $q$ is a suitably selected constant value.

The compression logic 15 will be subsequently explained in connection with FIGS. 2, 4 and 5. It basically serves the purpose to compress the digital input signals, that is to convert them into output tuples having fewer levels than the quantized input signals or tuples.

The digital speech compression system of FIG. 1 includes a predictor loop 16 which is a predictive feedback between the compression logic 15 and the adder 12. The predictor loop 16 includes a second adder 17 and a filter 18 which has been designated P (Z) filter. This is a digital predictive filter and may consist of any digital filter which will estimate an input signal. It may also include an electrical filter for suppressing certain frequencies and enhancing others.

Hence, as shown in FIG. 1, the compression logic 15 is coupled to an input of the adder 17. The output of the adder 17 is connected to the input of the predictive filter 18. Its output is connected both in a negative sense to the first adder 12 and in a positive sense to the second adder 17, thus to complete the feedback loop.

The digital signal impressed on the filter 18 may be termed $r_i$ which is the reconstructed signal. If the input signal obtained from analog-to-digital converter 11 and impressed on adder 12 is termed $S_i$, the signal feedback to the adder 12 from the filter 18 is $\hat{S}_i$. This is the estimate of the actual input signal $S_i$. The signal impressed by the adder 12 on the quantizer 14 may be termed $e_i$ and this represents the error of the original estimate.

How this system can be realized will now be explained in connection with FIG. 2. As shown here, the first adder 12 has its output connected to a hard limiter 20, that is a two-valued output limiter. Its input signal is $e_i$, that is the error of the estimate while its output signal $q_i$ is the quantizer output.

The limiter 20 is followed by a compressor 21 identified by Q → C. This in turn is followed by a converter 22 forming part of the feedback loop. The converter 22 is identified by C → Q. The output of the converter 22 feeds into an input of the second adder 17 having its output connected to the filter 18 as previously described. The signal $r_i$ is the residue signal which is fed from the adder 17 to the filter 18. As previously explained the output of filter 18 is connected in a negative sense to adder 12 and in a positive sense to adder 17. The output signal which is shown by output lead 24 as going to the transmission channel carries the output signal $c_k$.

The meaning of the terms Q, C, and $\hat{Q}$ will now be explained. Q is, of course, the set of output signals of the limiter 20 or the quantizer output. Q is a set of $n$ tuples and each element of the $n$-tuple termed $q_i$ where $q_i = +q$ or $q_i = -q$.

C represents a digital output signal which has fewer levels than the output signal Q. It consists of a set C of $m$ tuples $C_k$ of binary numbers fed to the output channel where $m$ is smaller than $n$.

Finally $\hat{Q}$ consists of $n$ tuples of $\hat{q}_i$ where each $q_i$ is either $+q$ or $-q$. This is a coded set of digital levels where the quantized levels feed to the predictor loop.

For a better understanding of the meaning of the terms Q, $\hat{Q}$ and C, reference is made to the following Table I.

TABLE I

| | Q | $\hat{Q}$ | C |
|---|---|---|---|
| 0 | 000 | 000 | 00 |
| 1 | 001 | 001 | 01 |
| 2 | 010 | 000 | |
| 3 | 011 | 001 | |
| 4 | 100 | 100 | 10 |
| 5 | 101 | 101 | |
| 6 | 110 | 100 | 11 |
| 7 | 111 | 101 | |

In the above table the first column indicates the digital numbers from 0–7 and the next column the corresponding binary numbers which are termed Q. Each tuple in column Q is composed of 3 values of $q_i$, i.e. ($q_1$, $q_2$, $q_3$) where each $q_i$ may be $+q$ or $-q$. Here for convenience $+q$ has been denoted as 1 and $-q$ as 0, i.e., the first entry in the second column corresponds to ($-q$, $-q$, $-q$). $\hat{Q}$ shown in the third column represents a coded set of digital signals $q_i$. This is simply obtained from the second or Q column by changing the second binary digit of each tuplet to 0. The same representation of $+q$ as 1 and $-q$ as 0 is used. The last or C column illustrates the digital output signals which have fewer levels, that is two levels instead of three.

Because the $\hat{Q}$ column has only zeros in the middle position of bits or tuples, these bits can be omitted because they represent no information. As a result decimal 0 and 2 both are represented by 00; decimal 1 and 3 are both represented by 01 and so on.

A code of the type illustrated in the above table can be readily obtained by using a so-called Q where the tree represents the $\hat{Q}$ space. With this information the meaning of the block diagram of FIG. 2 will become more meaningful. Thus, the compressor 21 converts the quantized digital signals Q into the digital output signals C having fewer levels. The converter 22 now converts C into $\hat{Q}$, that is the digital output signals C having fewer levels are converted into the coded set of digital levels $\hat{Q}$, which then flows in the predictor loop.

The embodiment of the invention of FIG. 2 has the advantage that it is relatively easily implemented. In this embodiment, as well as in the others, compression is achieved by limiting the number of sequences of $q$ levels that may be fed back into the loop. The compression ratio is $m/n$ and the circuit of FIG. 2 operates on a sample-by-sample basis. The particular code which can be used with the configuration of FIG. 2 is somewhat limited. In other words, there is a limited choice of codes available.

Figure 3:
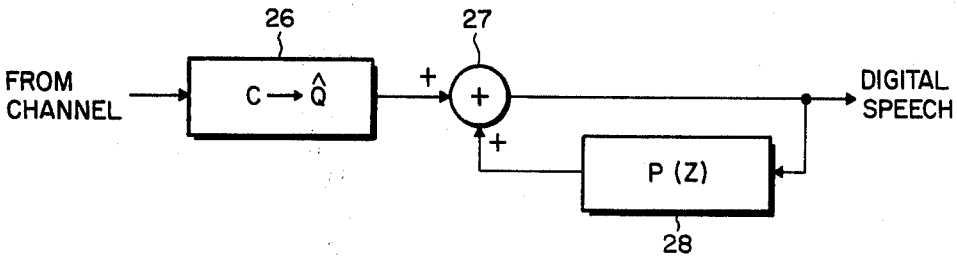
FIG. 3 is a block diagram of a receiver for decoding the received compressed digital signals.

FIG. 3 illustrates schematically a receiver from which the digital speech can be recovered. This includes a converter 26 which converts C into $\hat{Q}$ followed by an adder 27. The output of the adder is fed back into the adder 27 by a digital predictive filter 28 identical to the filter 18. Such a feedback loop at the receiver is conventional.

Referring now to FIG. 4, there is illustrated another block diagram of an embodiment of the invention which operates on a sample-by-sample basis. It is generally similar to that of FIG. 2 except that the limiter 20 is now followed by a converter 30 which converts Q to $\hat{Q}$. The output of the converter 30 is directly impressed on the adder 17 and the predictive feedback loop is identical to that previously described. However, outside of the feedback loop there is provided a compressor 31 which converts $\hat{Q}$ into C to derive the output tuples $c_k$. The circuit of FIG. 4 has certain advantages in that it provides a larger choice of possible codes.

However, the codes applicable to the embodiment of FIG. 2 form a subset of the codes which can be used in FIG. 4. While the embodiment of FIG. 4 can also be readily implemented, it requires more hardware than that of FIG. 2.

The codes required to convert Q into C and C into Q or to convert Q into $\hat{Q}$ into C will now be explained.

Thus a function F must be found mapping Q into Q. This may be explained as follows: Thus $$F(q) = \hat{q} \quad (1)$$

must be decomposable as $$F_i(q_1, q_2, \ldots q_i) = \hat{q}_i, \text{ where } i = 1, \ldots, n \quad (2)$$

In addition F must be decomposed into two functions.

$$G: Q \rightarrow C \text{ and } D: C \rightarrow Q$$

It will be evident that since G maps n-tuples to m-tuples there must be $n - m$ sample intervals out of every n intervals during which G produces no output. This corresponds to the speech compressor illustrated in FIG. 2. Concerning the scheme of FIG. 4, this implements any code F:Q → Q which satisfies equation (2). As indicated before, the map of the F function can be realized by an automaton, that is by the Q tree previously referred to.

The map $$D^{-1}: Q \rightarrow C$$

can be realized but with a delay of at most $n$ sample intervals. This delay occurs outside of the feedback loop and hence is permissible. This is particularly true because greater delays do occur in practice between the transmitter and the receiver. A sample of a code selected in this manner has been shown in Table I.

The following Table II is similar and will now be explained.

TABLE II

| | Q | $\hat{Q}$ | C |
|---|---|---|---|
| 0 | 000 | 000 | |
| 1 | 001 | 001 | |
| 2 | 010 | 010 | 00 |
| 3 | 011 | 111 | 01 |
| 4 | 100 | 000 | |
| | | | 10 |
| 5 | 101 | 001 | |
| | | | 11 |
| 6 | 110 | 010 | |
| 7 | 111 | 111 | |

In the above Table II the rows for Q, $\hat{Q}$ and C are defined as before. The Q again indicates the coded set of digital levels. It will be noted that the tuples of the C column are obtained from the tuples of the Q column by omitting the first bit of each $\hat{Q}$ tuple.

It will be further realized by checking, for example, the coded $\hat{q}$'s corresponding to decimal numbers 2 and 3, that these tuples cannot be obtained from the corresponding q tuples by only looking at the first bit that is received. The same applies to the last two sets of $q$ tuples, decimal numbers 6 and 7, which cannot be obtained from the last two $\hat{q}$ tuples without receiving both the first and second bit.

It will therefore be realized that the code represented by Table II cannot be performed with either the circuit of FIG. 2 or that of FIG. 4 because there is no provision for looking at more than one bit at a time. This can be accomplished with the circuit of FIG. 5 which includes a blocking control so that the input signals $S_i$ are coded block by block. Each of these blocks may, for example, correspond to the number $n$ and in the case to Table II this amounts to $n = 3$.

Accordingly, reference is now made to FIG. 5 which shows a blocking control 35 upon which the input signals $S_i$ are impressed. The output of the blocking control is again fed to the first adder 12, the output of which is the $e_i$ signal. It is impressed upon a decision logic circuit 36 which will be subsequently explained. The output of the decision logic circuit obtained from lead 37 corresponds to the output signals $c_k$. A sequence generator 38 is provided which feeds sequentially coded signals into the decision logic circuit 36 and to the second adder 17. In other words the output of the sequence generator is $\hat{Q}$. Consequently the individual sequences q which comprise $\hat{Q}$ are sequentially generated by the sequence generator 38.

The remainder of the circuit of FIG. 5 is similar to the circuits previously described. In other words, the output of the second adder 17, that is the $r_i$ or reconstructed signal, is impressed upon the digital predictive filter 18 and its output is again impressed upon the two adders 12 and 17. This output is the signal $\hat{S}_i$. In other words, this is the estimate of the input signal.

The decision logic selects the best sequence or the minimum error (mean squared error) which is calculated as follows:

$$\Sigma (S_i - \hat{S}_i)^2 = \Sigma e_i^2; \quad S_i - \hat{S}_i = e_i \quad (3)$$

Equation (4) will be evident from what has been explained before. In other words the difference between the actual input signal $S_i$ and the estimate $\hat{S}_i$ corresponds to the error signal $e_i$.

Thus basically the circuit of FIG. 5 operates as follows: the blocking control 35 reads and holds a block of input signals corresponding to the number $n$. Each signal is then fed through the circuit and passes the decision logic circuit 36. This will receive simultaneously the error signal $e_i$ which is held by the decision logic and a $\hat{q}$ received from the sequence generator 38. Every time the mean squared error of equation (3) is determined and every time the smallest mean square and the corresponding state of the filter 18 are retained by the decision logic. Hence, if the previous mean square was smaller, the new mean square is discarded. If the new mean square is smaller it is saved in the decision logic to replace the previous mean square. This process continues until all of the $\hat{q}$ sequences in $Q$ have been generated. At this time the smallest mean square has been found and the corresponding filter state is entered in the filter 18. At the same time the corresponding $c_k$ is sent to the output channel.

Some general observations may be in order on assigning the codes and determining whether they can be carried out by the circuits of FIGS. 2, 4 or 5. Basically, these consist in selecting F, that is $$F: Q \rightarrow \hat{Q}$$

Words in Q with a high Hamming weight should be assigned to words in $\hat{Q}$ with a high Hamming weight and those with a low Hamming weight in Q should be assigned to a low Hamming weight in $\hat{Q}$. The Hamming weight of a word is defined as the sum of the Hamming weights of its digits which is either 0 or 1, if the weight is not zero.

$\hat{Q}$ should be chosen so that the sum of the Hamming weights of all words in $\hat{Q}$ is approximately $2^{m-1} \times m$. This simply means that there is an equal number of 1's and 0's in $\hat{Q}$. Finally $\hat{Q}$ should be chosen to maximize the minimum distance between words.

Any code selected in this manner will work with one of the circuits of FIGS. 2, 4 and 5.

Figure 6:
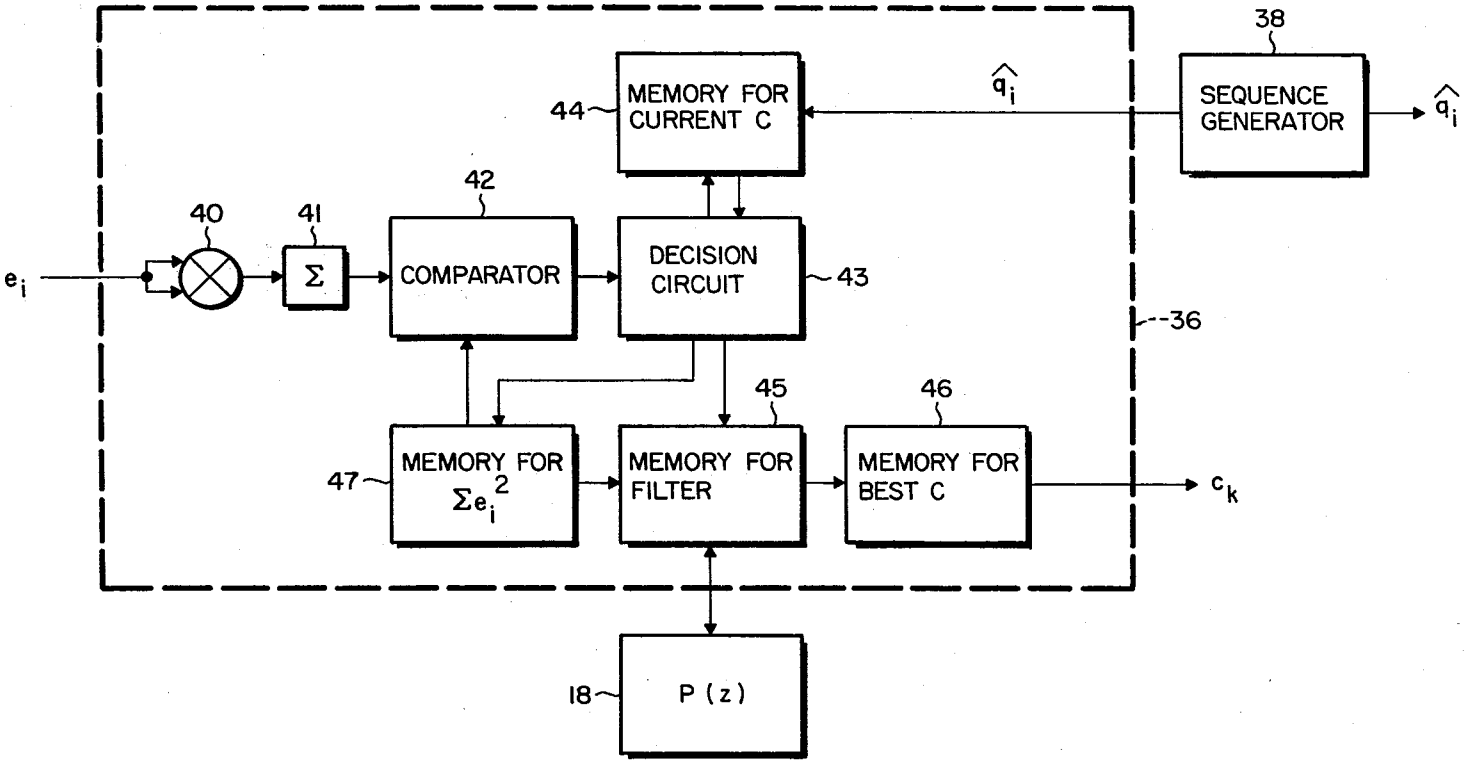
FIG. 6 is a block diagram of a portion of the circuit of FIG. 5, including the decision logic circuit.

Referring now to FIG. 6 there is illustrated primarily the decision logic circuit of FIG. 5. Thus FIG. 6 shows the error signals $e_i$ from the adder 12 which feed into the decision logic circuit 36 shown in dotted lines. The sequence generator 38 generates the signals $\hat{q}_i$ which are fed to the second adder 17. Also the sequence generator 38 will impress the coded set of signals $\hat{q}_i$ on the decision logic circuit 36. Finally, the filter 18 has also been shown.

The input signal $e_i$ is squared by the multiplier 40 and the sum is formed by the summer 41. These two units operate for $n$ samples. The summing circuit 41 is followed by a comparator 42 which in turn impresses its output on the decision circuit 43. A memory circuit for the current C, that is circuit 44 is connected to the decision circuit 43. In other words the memory 44 will retain the current output signal $c_k$ corresponding to the $\hat{q}$ received from the sequence generator 38.

Another temporary memory 45 is connected to the output of the decision circuit 43. This will retain the filter state corresponding to the last $\hat{q}$, that is the one having the minimum value. Another memory 46 is coupled to the memory 45 and this will retain the corresponding $c_k$ signal corresponding to the presently best $\hat{q}$ signal and will eventually output the correct value of $c_k$.

Finally a memory 47 is coupled to the decision circuit 43 and its output is fed into both the comparator 42 and the memory 45. This will retain the last value of $\Sigma e_i^2$. In other words this corresponds to the best $\hat{q}$ so far found. Finally after $n$ samples have passed through the circuit, the final decision is made, the correct $c_k$ signal is fed into the channel, and the correct filter state is entered in the filter 18.

It should be noted that in the circuit shown in FIGS. 5 and 6, that is in the blocked compression, the explicit quantization function is not present but is inherently present in the circuit. Hence the blocked compression scheme is specified completely by a choice of $\hat{Q}$.

The various blocks illustrated in the drawings are well known in the art. In this connection reference is generally made to a publication by Burrough Corporation entitled "Digital Computer Principles" published by McGraw-Hill, 1962 (Ref. 1) and to a book by H. C. Thorng entitled "Switch Circuits" and published by Addison-Westley Publishing Company, 1972 (Ref. 2).

Thus, by way of example, the adders or subtractors 12 and 17 may be implemented with combinatorial circuits. Such circuits are referred to in Chapter 2 of Ref. 2 and are described in Chapter 19 of Ref. 1.

A predictor filter such as filter 18 may be constructed from adders and shift registers as discussed in Chapter 17 of Ref. 1. It may also include multipliers as disclosed on page 372 of Ref. 1.

The two-valued limited 20 may be implemented by a combinatorial circuit consisting of direct connections and an inverter, described on page 27 of Ref. 1.

A converter $Q \rightarrow \hat{Q}$ such as the converter 30 of FIG. 4, a compressor $Q \rightarrow C$ such as the compressor 21 of FIG. 2 and a converter $C \rightarrow \hat{Q}$ such as the converter 22 of FIG. 2 may be implemented by using sequential circuits which are discussed in Chapter 20, Ref. 2.

A compressor $\hat{Q} \rightarrow C$ such as the compressor 31 may be implemented by the use of shift registers and combinatorial circuits which are described as indicated above.

Concerning the blocking control 35 and sequence generator 38 of FIG. 5, these may be implemented with shift registers and timing circuits and for a description thereof reference is made to Chapter 13, Ref. 1.

Finally the decision logic circuit 36 of FIGS. 5 and 6 may be realized by shift registers, an adder, a multiplier and combinatorial circuits referred to hereinabove.

There have thus been disclosed various digital speech compression systems where the feedback residue compression takes place in the feedback loop. The circuits are characterized in that some of them require considerably less hardware than other circuits. In other cases there is a wide choice of codes that can be selected for the compression scheme. All circuits feature a predictive loop which feeds back into two separate adders. The selection of the codes has been discussed and how it can be determined which circuit or scheme can be used for a particular code.

What is claimed is:

1. A digital speech compression system comprising:

a. a digital source of speech;

b. a first digital adder;

c. a quantizer;

d. a compression logic, said source having its output connected to said first adder, and said quantizer and compression logic being connected in cascade to an output of said first adder, the output of said compression logic being the compressed digital speech; and e. a predictor loop connected between said compression logic and a negative input of said first adder, said predictor loop including;

f. a second digital adder; and g. a digital predictive filter, said compression logic being coupled to an input of said adder which in turn is connected to said filter and to the negative input of said first adder, the output of said filter being further connected to another input of said second adder, whereby the residue stream of digital data is estimated inside said predictor loop.

2. A digital speech system having a sample-by-sample compression and comprising:

a. a source of digital speech signals;

b. a first digital adder;

c. a two-valued limiter for generating quantized digital signals;

d. means for converting the quantized digital signals into a coded set of digital signals;

e. a second digital adder, said first adder, limiter, means for converting and second adder being connected in cascade;

f. a digital predictive filter having its input connected to the output of said second adder and having its output connected in a negative sense to said first adder and in a positive sense to said second adder; and g. a compressor coupled to said means for converting for generating digital output signals having fewer levels than those of the quantized digital signals.

3. A digital speech system having sample-by-sample compression and comprising:

a. a source of digital speech signals;
b. a first digital adder;
c. a two-valued limiter for generating quantized digital signals;
d. a digital compressor having digital output signals having fewer levels than the quantized digital signals, said limiter and compressor being connected in cascade to the output of said adder; and
e. a predictor loop, said loop including:
f. a digital converter for converting the digital output signals of said compressor to a coded set of digital levels corresponding to the set of quantized digital signals;
g. a second digital adder; and
h. a predictive digital filter, said converter having its output connected to said adder, the output of said second adder being connected to said filter, said filter having its output connected to said second adder as an input and further having its output connected to said first adder in a negative sense.

4. A digital speech system having sample-by-sample compression and comprising:
a. a source of digital speech signals;
b. a first digital adder;
c. a digital two-valued limiter for generating quantized digital signals;
d. a digital converter for converting the quantized digital signals into a coded set of digital signals, said adder, said limiter and said converter being connected in cascade;
e. a second digital adder having its input connected to the output of said converter;
f. a predictive digital filter having its input connected to said second adder and having its output connected to the negative input of said first adder and to the input of said second adder; and
g. a compressor connected to the output of said converter for converting the coded set of digital signals into digital output signals having fewer levels.

5. A digital speech system having block-by-block compression and comprising:
a. a source of digital speech signals;
b. a blocking control;
c. a first digital adder connected to said blocking control, said digital speech signal being impressed on said blocking control, said blocking control passing consecutive input signals block by block;
d. a decision logic circuit following said first adder and for generating digital output signals having fewer levels than the digital input signals;
e. a sequence generator for generating cyclically a coded set of digital signals;
f. a second digital adder coupled to said sequence generator; and
g. a predictive digital filter having its input connected to said second adder and having its output connected in a negative sense to said first adder and in a positive sense to said second adder, said decision logic circuit being coupled to said filter: said decision logic circuit including means for generating the mean squared of an earlier signal and for deciding upon the smallest error signal within each block to generate the digital output signal and to store successive digital signals corresponding to the least mean squared value previously found.

6. A digital speech system as defined in claim 5 wherein said decision logic circuit includes means for squaring and summing the error signal obtained from said first adder, a comparator following said summer, a decision circuit following said comparator, a first memory for said filter coupled to said decision circuit and to said filter, a second memory for the current output signal and coupled to said decision circuit and to said sequence generator, a third memory for the best output signal coupled to said filter, and a fourth memory for the sum of the square of the error signal having its output coupled to said comparator and to said first memory and having its input coupled to said decision circuit.

* * * * *

UNITED STATES PATENT OFFICE

CERTIFICATE OF CORRECTION

PATENT NO. : 3,973,081

DATED : August 3, 1976

INVENTOR(S) : Sandra E. Hutchins

It is certified that error appears in the above-identified patent and that said Letters Patent are hereby corrected as shown below:

Column 8, line 42 after "said" the word

--second-- should be inserted.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*